US010657950B2

(12) United States Patent
Hua et al.

(10) Patent No.: US 10,657,950 B2
(45) Date of Patent: May 19, 2020

(54) HEADPHONE TRANSPARENCY, OCCLUSION EFFECT MITIGATION AND WIND NOISE DETECTION

(71) Applicant: Apple Inc., Cupertino, CA (US)

(72) Inventors: Thanh Phong Hua, San Jose, CA (US); Esge B. Andersen, Campbell, CA (US); Tom-Davy W. Saux, Los Altos, CA (US); Scott C. Grinker, Belmont, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/036,806

(22) Filed: Jul. 16, 2018

(65) Prior Publication Data

US 2020/0020313 A1 Jan. 16, 2020

(51) Int. Cl.
*G10K 11/178* (2006.01)
*H04R 1/10* (2006.01)

(52) U.S. Cl.
CPC .. *G10K 11/17823* (2018.01); *G10K 11/17854* (2018.01); *H04R 1/1016* (2013.01); *H04R 1/1083* (2013.01); *G10K 2210/1081* (2013.01); *G10K 2210/3026* (2013.01); *G10K 2210/3027* (2013.01); *G10K 2210/3028* (2013.01); *H04R 2460/09* (2013.01); *H04R 2460/13* (2013.01)

(58) Field of Classification Search
CPC combination set(s) only.
See application file for complete search history.

(56) References Cited

U.S. PATENT DOCUMENTS 5,309,922 A * 5/1994 Schechter ..... A61B 7/003 600/534
5,692,059 A * 11/1997 Kruger ..... H04R 1/1016 381/151
5,937,070 A * 8/1999 Todter ..... G10K 11/178 381/71.6
6,151,400 A * 11/2000 Seligman ..... H03G 3/3005 381/101
6,870,881 B1 * 3/2005 He ..... H04L 25/03057 375/233

(Continued)

OTHER PUBLICATIONS

U.S. Appl. No. 15/607,051, filed May 26, 2017.

*Primary Examiner* — Duc Nguyen
*Assistant Examiner* — Assad Mohammed
(74) *Attorney, Agent, or Firm* — Womble Bond Dickinson (US) LLP

(57) ABSTRACT

A headphone has a driver, an internal microphone, an accelerometer, and an external microphone. An audio processor analyzes signals to detect wind noise. Gain of lower frequencies is reduced relative to higher frequencies, in a first filter that is operating on an audio signal from the external microphone in a feedforward path, responsive to detecting increased wind noise. A second filter in an audio signal feedback path may be adjusted to compensate for the gain change in the first filter that may mitigate occlusion effect. Outputs of the feedforward path in the feedback path are combined to produce an audio signal for the driver. The driver produces sound in the aural canal that has transparency with reduced wind noise, relative to sound external to the headphone. Other aspects are also described and claimed.

20 Claims, 8 Drawing Sheets

(56) References Cited

U.S. PATENT DOCUMENTS

| | | | | |
|---|---|---|---|---|
| 2002/0126852 | A1* | 9/2002 | Kashani | G10K 11/178 381/71.4 |
| 2005/0007445 | A1* | 1/2005 | Foote | H04N 7/142 348/14.08 |
| 2014/0093093 | A1* | 4/2014 | Dusan | H04R 3/005 381/74 |
| 2017/0148428 | A1* | 5/2017 | Thuy | G10L 25/78 |
| 2017/0171679 | A1 | 6/2017 | Isberg et al. | |
| 2019/0069074 | A1* | 2/2019 | Yamkovoy | H04R 1/1083 |

* cited by examiner

HEADPHONE TRANSPARENCY, OCCLUSION EFFECT MITIGATION AND WIND NOISE DETECTION

An aspect of the disclosure here relates to audio processing for headphones. Other aspects are also described.

BACKGROUND

Headphones, as a single headphone for one ear, or a set of two with one headphone for each ear, are in popular use for listening to music, speech during a mobile phone call, or other audio. When using a headphone of any type, whether in the ear, over the ear or around the ear, the user is acoustically cut off from the surrounding environment. The user experiences a loss of high-frequency sound components due to passive attenuation of the ear cup or earbud.

SUMMARY

Various versions of an audio processing system having headphones are presented herein. In one aspect of the disclosure here, an audio processor is configured for a transparency effect, and for occlusion effect mitigation. Some versions also have reduced sensitivity to wind noise.

The headphone has a driver (one or more earpiece acoustic transducers or speakers), an external microphone and an internal microphone. The driver and the internal microphone are located within a headphone housing so as to face (or be on a straight path to) an aural canal of the ear against which the headphone housing is fitted. The headphone also has an accelerometer within the headphone housing to receive vibration through bone conduction.

The audio processor (which may be a digital audio processor integrated within the headphone housing) is to analyze signals from the internal microphone, the external microphone and the accelerometer to detect wind noise. The audio processing has a first filter that is to reduce gain of lower frequencies relative to higher frequencies of the signal from the external microphone, in a feedforward path. The gain of the lower frequencies is reduced relative to the higher frequencies, responsive to detecting increased wind noise.

The audio processing is to also adjust a second filter that filters the signal from the accelerometer. The second filter is in a feedback path. The second filter may be adjusted to compensate for the reduced gain of the lower frequencies relative to the higher frequencies in the first filter. The adjusting of the second filter may mitigate the occlusion effect (that is caused by positioning of the headphone relative to the aural canal.)

Outputs of the feedforward path and the feedback path are combined to produce an input signal for the driver. These outputs are combined so that the driver produces sound in the aural canal that not only has transparency, or contains the sound of the surrounding environment which is external to the headphone, but also with reduced wind noise (i.e., reduced relative to the wind noise that is in the sound external to the headphone as might be captured for example by the external microphone.)

Another aspect of the disclosure here is a method of audio processing for transparency with occlusion effect mitigation for headphones. The method includes analyzing signals from an internal microphone, an external microphone and an accelerometer of a headphone, to detect wind noise. The method includes reducing gain of a first filter in lower frequencies relative to higher frequencies, where the first filter is to filter the signal from the external microphone (and not the signal from the accelerometer) in a so-called feedforward path. The gain reduction is responsive to detecting increased wind noise.

The method also includes adjusting a second filter that is in a so-called feedback path, in which the second filter is to filter the signal from the accelerometer (and not the signal from the external microphone.) Adjusting the second filter is also based on detecting the increased wind noise. The adjusting of the second filter may be designed to compensate for the reduced gain of the lower frequencies relative to the higher frequencies in the first filter. The adjusting the second filter may mitigate the occlusion effect (that is caused by positioning of the headphone relative to an aural canal.)

The method includes combining output of the feedforward path and output of the feedback path to produce a signal for the driver. As a result the driver produces sound in the aural canal that has transparency with reduced wind noise, relative to sound external to the headphone.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

To aid the Patent Office and any readers of any patent issued on this application in interpreting the claims appended hereto, applicant wishes to note that they do not intend any of the appended claims or claim elements to invoke 35 U.S.C. 112(f) unless the words "means for" or "step for" are explicitly used in the particular claim.

Since headphones muffle external sound, some headphones are equipped with a transparency feature that uses an external microphone and amplification to bring external sounds into the aural canal, so that the wearer can hear and be aware of surroundings. However, there is an occlusion effect with headphones, where sounds such as a headphone wearer's speech (i.e., voice), breath, heartbeat and footfalls are delivered by bone conduction to the aural canal, and are perceived as prominent or over-emphasized, thus modifying the headphone wearer's experience. Speech, for example, may be perceived as booming, with lower frequencies emphasized due to the occlusion effect.

Headphones with a transparency feature also suffer from wind noise picked up by the external microphone, for example during windy conditions, walking in the street, bicycling, etc. The wind noise is picked up by the external microphone, which is directly exposed to wind, and is amplified by the transparency feature. Headphones with a transparency feature and an occlusion effect mitigation feature (that uses an internal microphone) may make the amplified wind noise even worse in the aural canal, especially in low frequencies, e.g., 80 Hz-600 Hz. Indeed, to achieve transparent external sounds, the transparency feature has to compensate for the voice occlusion cancellation from the feedback ANC filter, by amplifying the frequencies between 80 Hz and 600 Hz. In other words, the amplified wind noise in the low frequencies is a consequence of the occlusion effect mitigation, where the feedback ANC (with internal microphone) cancels too much of the external sounds. In various examples described herein, the occlusion effect is better suppressed via an accelerometer, and external sounds are faithfully reproduced at the eardrum, without amplifying the low frequencies of the wind noise. Some versions of the headphones use active control of digital audio filters as wind conditions change.

Figure 1:
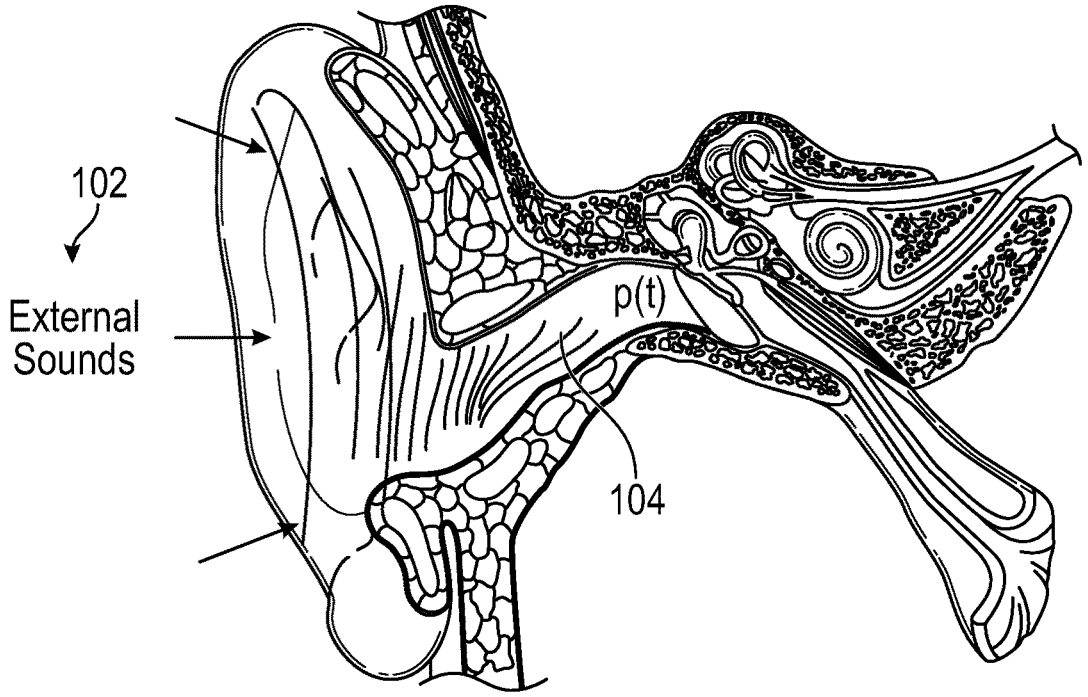
FIG. 1 illustrates external sounds entering the aural canal of an ear.

FIG. 1 illustrates external sounds 102 entering the aural canal 104 of an ear. Sound pressure as a function of time is denoted as p(t). The auditory system includes many components that determine ability to hear in different environments. Obstructing any part of the path into or in the aural canal 104 distorts the perception of the original sound signal, changing timbre, level and apparent location (i.e., perception of location) of a sound source.

Figure 2:
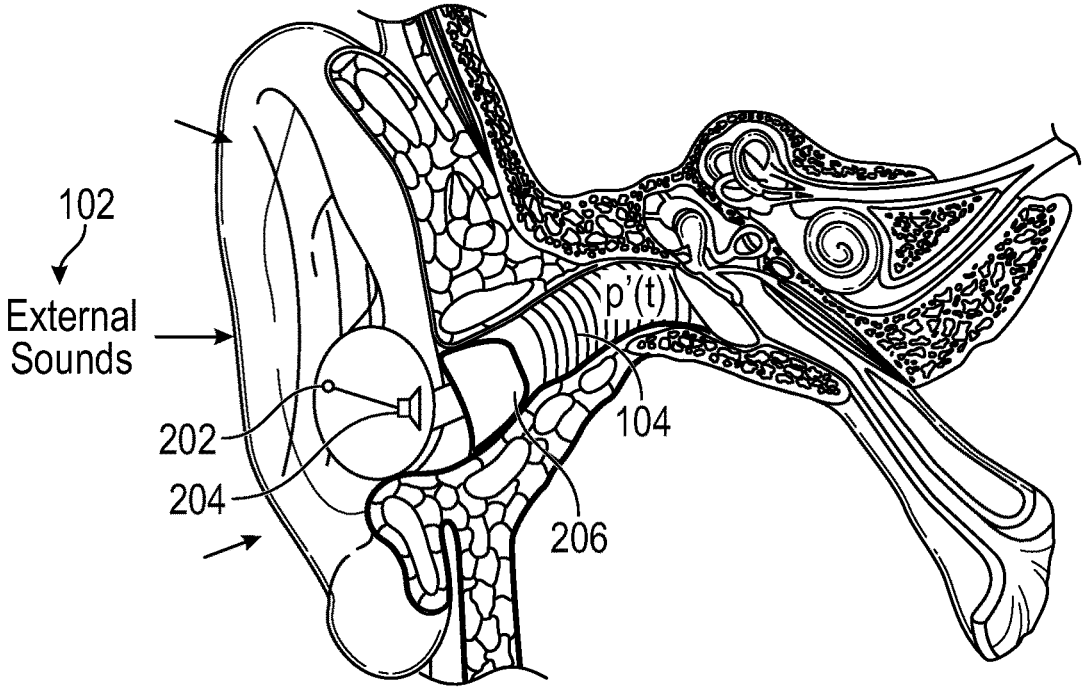
FIG. 2 depicts external sounds modified by a headphone, which forms an obstruction to the aural canal.

FIG. 2 depicts external sounds 102 modified by a headphone 206, which forms an obstruction to the aural canal 104. In the example shown in FIG. 2, the headphone 206 is an ear bud, partially inserted into the aural canal 104. But it should be appreciated that other types of headphones (e.g. on ear, over ear, around ear, etc.) also form obstructions to varying degrees. To overcome the effects of sound modification that are due to obstructions, an external facing microphone, here an external microphone 202, is used to pick up ambient sound from outside of the aural canal 104 and outside of the headphone 206 (that is also referred to here as external sound.) Audio processing through a filter, which may include amplification, is applied to the signal from the external microphone 202 to produce a signal for driving the speaker 204. Sound pressure in the aural canal 104, as modified by the obstruction and by the audio processing and the output of the speaker 24 is denoted p'(t). The filter is designed so that p'(t) approximates p(t). The filter is tuned to take into account and offset or compensate for sound loss that is due to the obstruction, at various frequencies.

Figure 3:
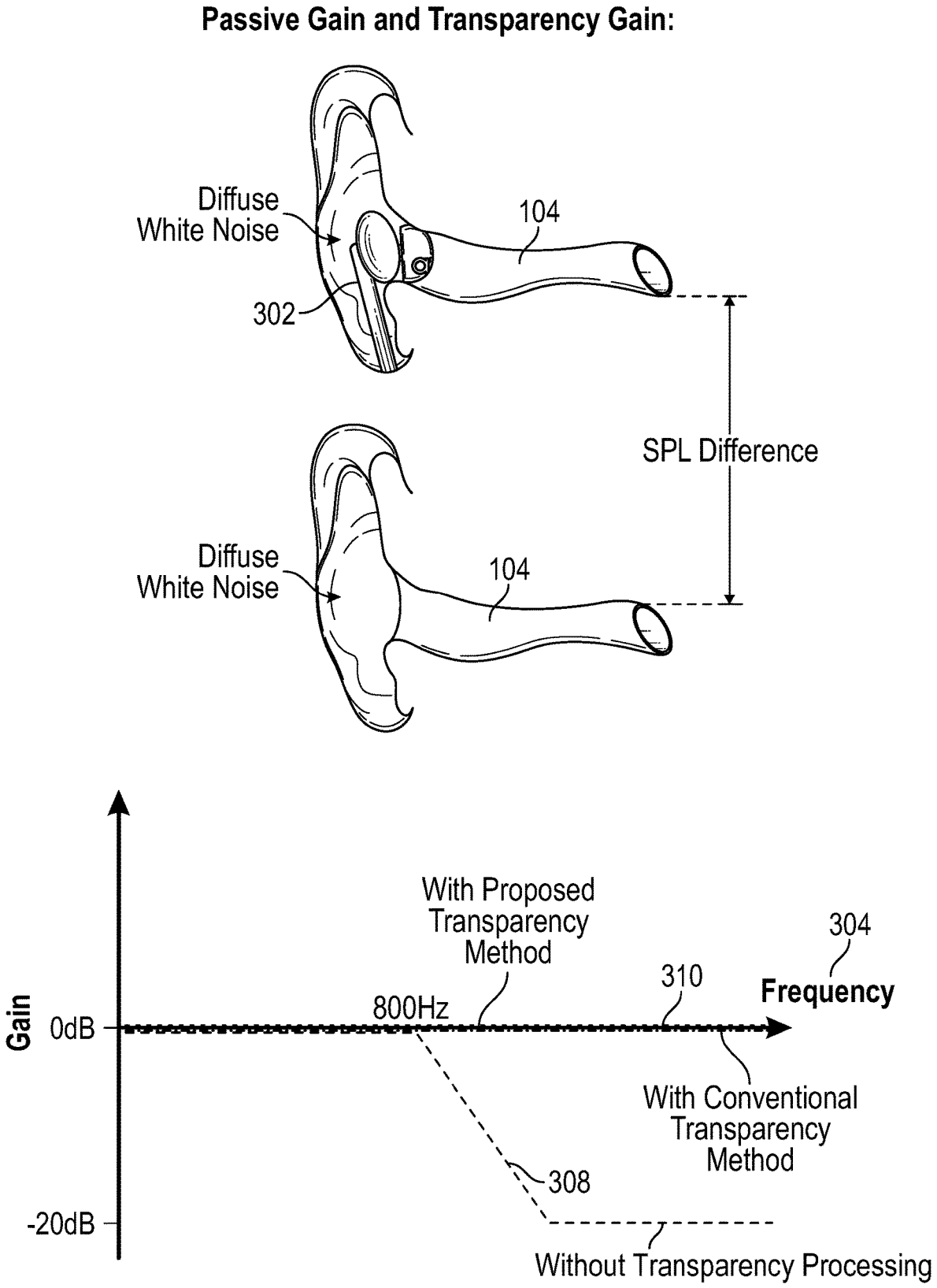
FIG. 3 illustrates passive gain (no electronic processing) for external sounds from outside a headphone to inside the aural canal, and transparency gain (electronic processing of the external sounds), in ideal cases (without bone conduction and without wind noise.)

FIG. 3 illustrates how external sounds are modified, due to the obstruction by a headphone, in this example an earbud 302 that is partially inserted into the aural canal. The modification may be measured as a sound pressure level (SPL) difference in the aural canal, between the unobstructed ear and the obstructed ear. The modification may be referred to here as a gain (and more specifically an attenuation), e.g., the SPL difference. When there is no obstruction, the gain is by definition a flat line, at 0 dB. The figure shows a passive gain 308 and a transparency gain 310. When there is obstruction (e.g., due to the earbud 302), but no transparency processing is being performed, the obstruction results in the external sound being subjected to a passive gain 308 (when they have reached the aural canal.) The external sound in this example is diffuse white noise with an even sound pressure level across a wide frequency range.

Ideally, when transparency processing is applied during obstruction, which plays back through a speaker in the earbud 302 a processed version of the external sound as it is picked up by an external microphone, the external sound is subjected to the transparency gain 310 which may be tuned to be flat across all frequencies, so that sound pressure as a function of time in the aural canal 104 is approximately equal to what the sound pressure as a function of time would be in the aural canal 104 without the obstruction from the earbud 302. Both types of audio processing for transparency, namely the accelerometer-absent version and the examples given below of the proposed transparency method with occlusion effect mitigation that uses an accelerometer, when properly tuned, can produce an effect that is close to the ideal transparency gain 310, in the absence of bone conduction and absence of wind noise.

Figure 4:
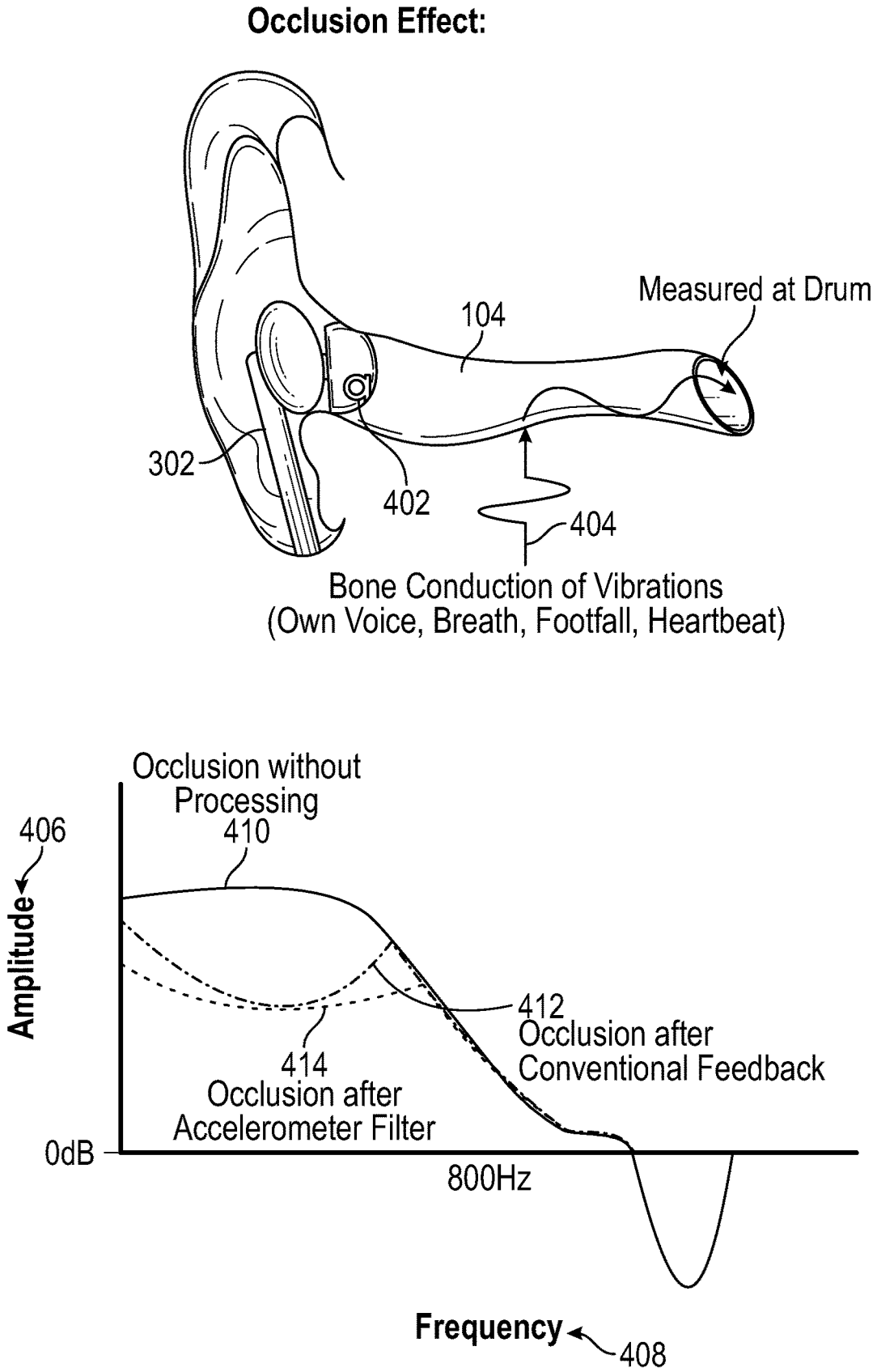
FIG. 4 illustrates the occlusion effect, in which bone conduction of vibrations increases sound amplitude at low frequencies in the aural canal, and occlusion mitigation with two different techniques.

FIG. 4 illustrates the occlusion effect, in which bone conduction 404 of vibrations in the body of the wearer increases sound amplitude at low frequencies in the aural canal. It also shows the effect of occlusion effect mitigation using two different techniques. With the earbud 302 creating the obstruction as discussed and shown in FIG. 3, external sound is attenuated in the aural canal 104. Vibrations from bone conduction 404, such as for the headphone wearer's voice, breath, footfall or heartbeat, reverberate in the now closed aural canal 104, reflecting off the obstruction rather than escaping from the aural canal 104 and thus become more prominent in the perception of the headphone wearer. The occlusion effect is illustrated in FIG. 4 by the graph of amplitude 406 versus frequency 408, with three curves, under various conditions. In occlusion without processing 410 (no transparent processing or simply passive attenuation), the amplitude 406 of sound pressure due to bone conduction 404 is larger for low frequencies, e.g., below 800 Hz, and drops for higher frequencies, e.g., above 800 Hz. In occlusion after acoustic-only feedback 412 (a particular version of transparency processing that does not use an accelerometer signal in the feedback path), some occlusion mitigation occurs due to audio processing (and subsequent playback through the speaker in the earbud 302) of the output of the external microphone 202 with a filter as described with reference to FIG. 2. This solution however provides moderate effectiveness in reducing the amplitude 406 of sound pressure levels from bone conduction 404. In occlusion after accelerometer filter 414, occlusion mitigation occurs due to audio processing (and subsequent playback through the speaker in the earbud 302) of the output of an accelerometer that is picking up bone conduction vibrations, with a filter, resulting in a further reduction of the amplitude 406 of the sound pressure levels from bone conduction 404, as shown. Several approaches for achieving this desirable, further reduction in SPL in the wearer's ear, using an accelerometer filter technique, will be described below, after a discussion of the effects of wind noise.

Figure 5:
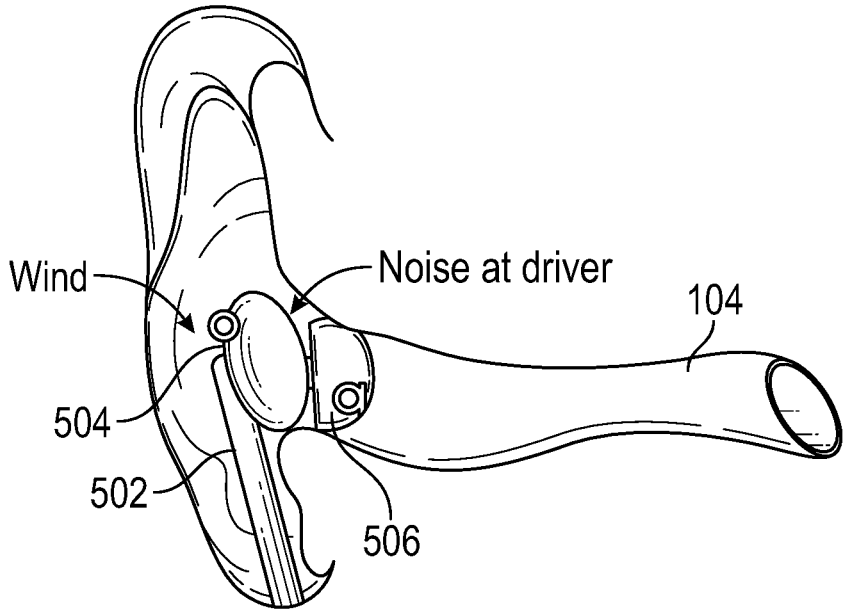
FIG. 5 illustrates the effects of wind noise on a headphone that has a transparency feature.
Figure 5:
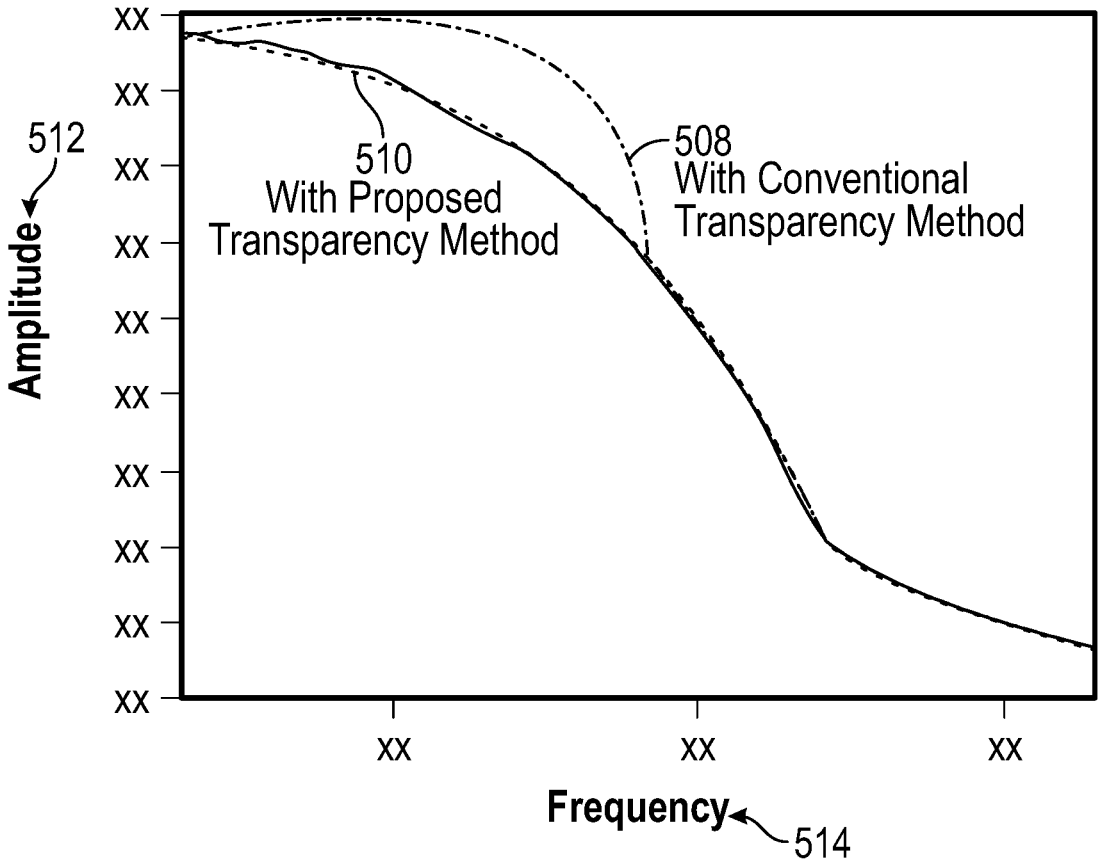

FIG. 5 illustrates the effects of wind noise on a headphone 502 that also implements a transparency feature. The headphone 502 has an external microphone 504 on the output of which audio processing for transparency is being applied, and an internal microphone 506 whose output is processed as part of an occlusion mitigation effort. Wind or wind noise is picked up by the external microphone 504 and brought into the aural canal 104 through the audio processing and playback in the transparency feature. Audio processing for the occlusion mitigation may however worsen the wind noise in the aural canal 104. In FIG. 5, the graph of sound pressure level in the aural canal, or amplitude 512 versus frequency 514, the curve representing an acoustic-feedback only transparency method 508 shows a large amount of wind noise present at the lower frequencies. In contrast, the curve for examples of the proposed transparency method 510 that use an accelerometer signal in the feedback path shows reduced wind noise in the aural canal 104. In other words, the curves illustrate how wind noise can be reduced, as compared to when a feedback filter 612 is operating upon the signal from the internal microphone rather than the signal from the accelerometer—this is explained further below in connection with FIG. 6.

Figure 6:
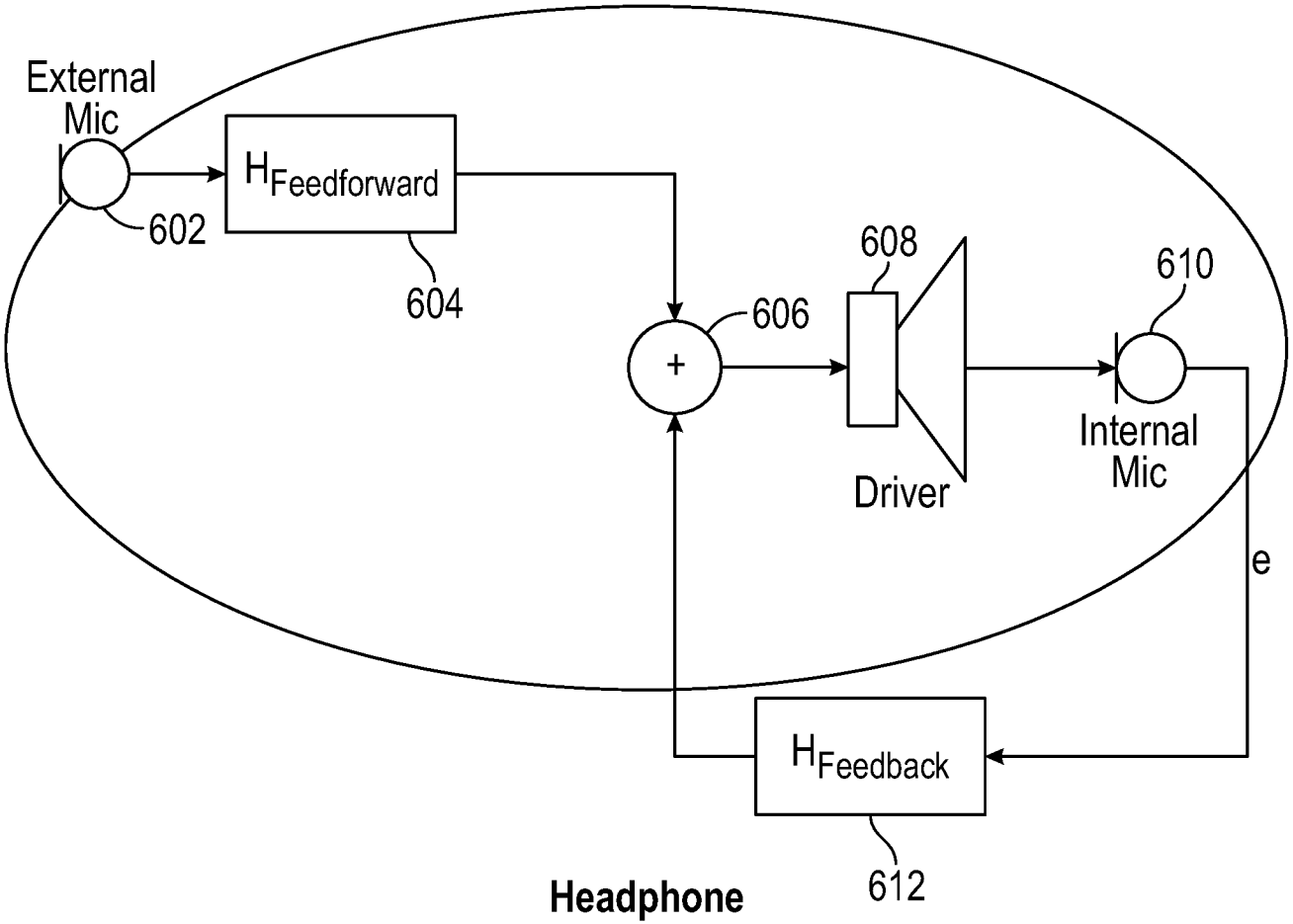
FIG. 6 is a system diagram of a headphone with a transparency feature that uses an external microphone in a feedforward path with a feedforward filter, and an internal microphone in a feedback path with a feedback filter, but no accelerometer.

FIG. 6 is a system diagram of a headphone with a transparency feature that uses an external microphone 602 in a feedforward path with a feedforward filter 604, and an internal microphone 610 in a feedback path with a feedback filter 612, and no accelerometer in the feedback path. The outputs of the feedback and feedforward paths are combined, for example in the summer 606 to form the signal for the driver 608. The feedback path uses the internal microphone 610, e.g., the microphone in the front cavity of the headphone, facing or inserted into the aural canal 104, to cancel sound waves that are due to bone conduction of wearer voice (voice occlusion) from around 80 Hz to 600 Hz. The feedforward path uses the external microphone 602 outside of the headphone to compensate for the passive attenuation of the headphone. The feedforward path thus amplifies both the high-frequency components, e.g., above approximately 800 Hz, and low-frequency components of the external sound, while those components tend to be suppressed by the feedback filter Hfeedback. Because of the feedback filter side effect of low-frequency suppression of the external sounds, the feedforward path amplifies the low frequencies and thus amplifies the wind noise.

Figure 7:
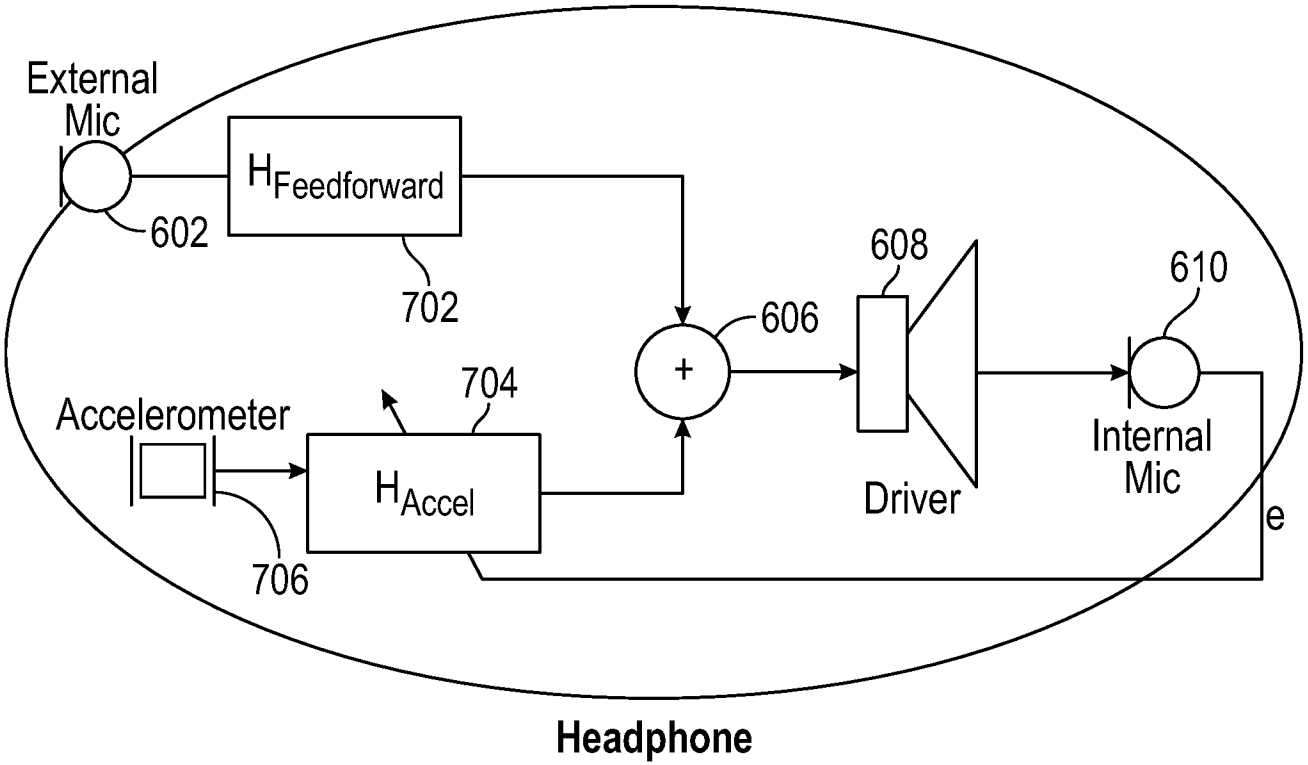
FIG. 7 is a system diagram of a headphone with a transparency feature using an external microphone in a feedforward path with a feedforward filter, and an accelerometer in a feedback path that has a filter controlled by a signal from an internal microphone.

FIG. 7 is a system diagram of a headphone with a transparency feature using an external microphone 602 in a feedforward path with a feedforward filter 702, and an accelerometer 706 in a feedback path whose output is filtered by a filter 704 whose response is controlled by a signal from an internal microphone 610. Note that in some versions, there may be a separate noise suppressor (not shown) that is operating upon the output of the accelerometer, to compensate for the higher noise floor that may be present in the output of the accelerometer. Outputs of the filters 702, 704 are combined, for example in the summer 606 to produce a signal for the driver 608. In this example, the accelerometer 706 replaces the internal microphone in the feedback path of the approach shown in FIG. 6. The accelerometer 706 does not pick up acoustic sounds, but only picks up vibrations. For example, the accelerometer 706 can pick up voice through bone conduction 404 but not surrounding or ambient sounds that are conveyed acoustically through air into the aural cavity 104. The feedforward filter 702 does not need to amplify the low frequencies anymore, and therefore the wind is not amplified.

In one version, the feedforward filter 702 is implemented with a high pass filter. This could also include amplification (of the high frequency components in the passband of the high pass filter.) With the combination of the high pass filter and the amplification, the feedforward filter 702 in that version would not amplify the low frequencies, but would amplify the higher frequencies, in the signal from the external microphone 602, to compensate for passive attenuation of higher frequencies by the headphone obstruction of the aural canal 104, and thus would deemphasize wind noise passed to the aural canal 104. The accelerometer 706 and filter 704 are tuned to offset or mitigate the occlusion effect, so that this version of the system shown in FIG. 7 advantageously provides both transparency and occlusion effect mitigation, all with reduced wind noise relative to sound external to the headphone.

Figure 8:
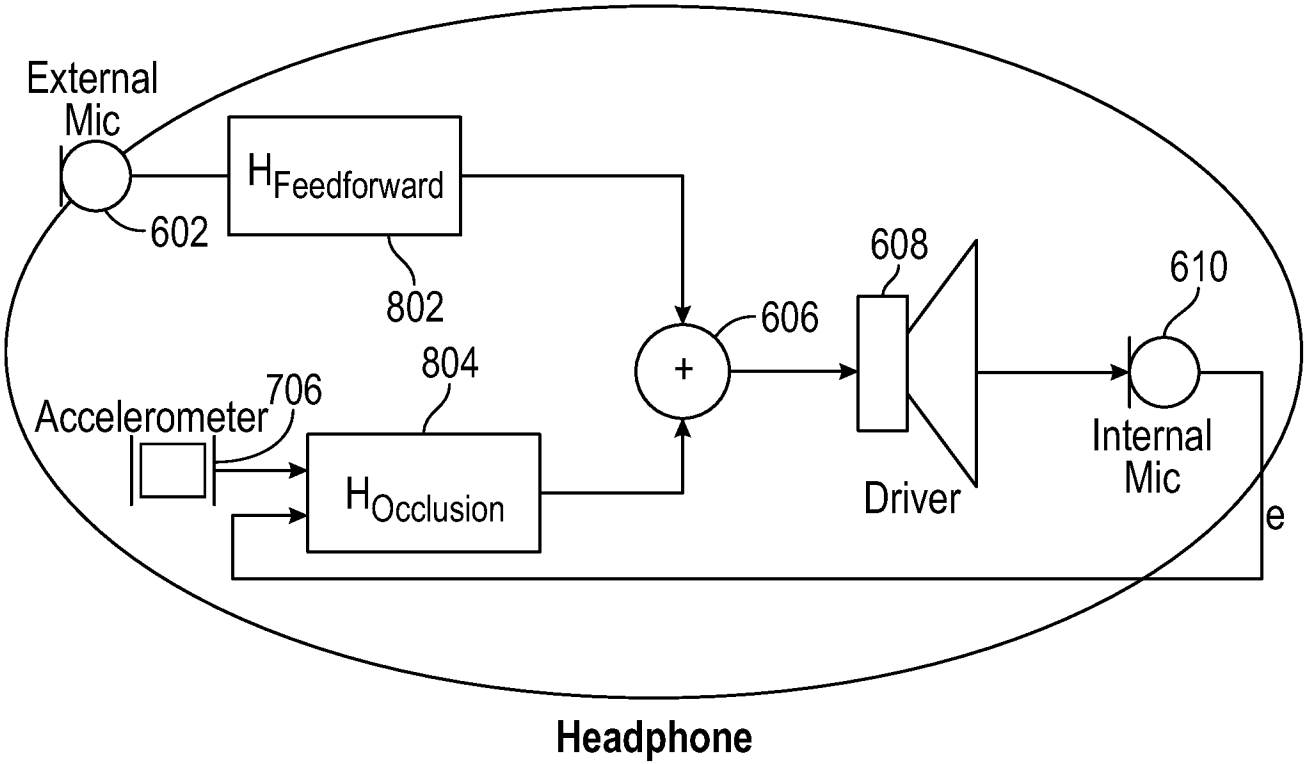
FIG. 8 is a system diagram of a headphone with a transparency feature using an external microphone in a feedforward path with a feedforward filter, and an accelerometer and an internal microphone in a feedback path with a feedback filter for occlusion mitigation.

FIG. 8 is a system diagram of a headphone with a transparency feature that uses an external microphone 602 in a feedforward path with a feedforward filter 802 operating upon the output of the external microphone in the path, and both an accelerometer 706 (picking up bone conduction vibrations of the wearer of the headphone) and an internal microphone 610 in a feedback path with a feedback filter 804. The feedback path may be for occlusion mitigation. Outputs of the filters 802, 804 or of the feedforward and feedback paths are combined, for example in the summer 606 to produce an input signal for driving the driver 608. In this example, the signals from the accelerometer 706 and internal microphone 610 are combined, e.g., into a single signal, before being operated upon by the feedback filter 804, which could also be termed an occlusion filter, in the feedback path. The feedback filter 804 is tuned for occlusion mitigation, using the combination of the accelerometer 706 and internal microphone 610.

FIG. 8 may combine some of the aspects described above with reference to FIG. 7. In one version of the system shown in FIG. 8, the feedforward filter 802 is implemented with a high pass filter. This could also include amplification of the high frequency components. With the combination of the high pass filter and the amplification, the feedforward filter 802 in this version would not amplify the low frequencies in the signal from the external microphone 602, but would amplify the higher frequencies to compensate for passive attenuation of higher frequencies by the headphone obstruction of the aural canal 104, and thus would deemphasize wind noise passed to the aural canal 104. Meanwhile, the accelerometer 706, the internal microphone 610 and the feedback filter 804 are tuned to offset or mitigate the occlusion effect, so that this version of the system shown in FIG. 8 provides both transparency and occlusion effect mitigation, all with reduced wind noise relative to sound external to the headphone.

Figure 9:
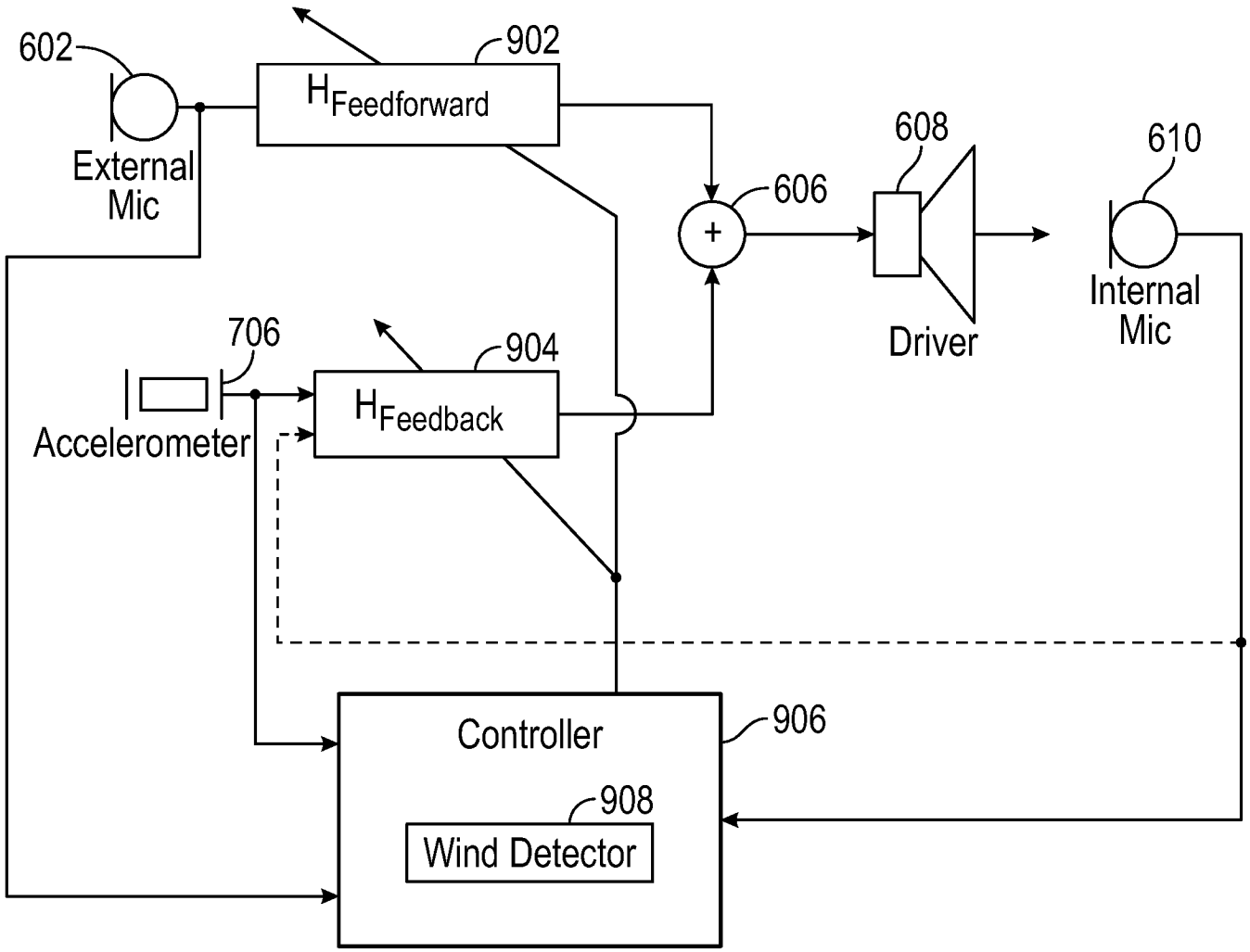
FIG. 9 is a system diagram of an audio processing system with a transparency feature using an external microphone in a feedforward path with a feedforward filter, and an accelerometer in a feedback path with a feedback filter for occlusion mitigation, with both filters controlled by a filter coefficient controller that detects wind by analyzing signals from the external microphone, the accelerometer, and an internal microphone.

FIG. 9 is a system diagram of a headphone with a transparency feature that uses an external microphone 602 in a feedforward path with a feedforward filter 902, and an accelerometer 706 in a feedback path with a feedback filter 904 (operating on the accelerometer signal, and not the signal from the external microphone) for occlusion mitigation. Here, both filters 902, 904 are controlled by a filter coefficient controller 906 that detects wind by analyzing one or more, e.g., all, of the signals from the external microphone 602, the accelerometer 706, and an internal microphone 610. In some versions, the signal from the internal microphone 610 is also input to the feedback filter 904, as shown by the dashed lines in FIG. 9 (e.g., the signal from the internal microphone 610 and the signal from the accelerometer 706 are combined into a single signal that is operated by the filter 904.) Various versions of this system may combine features from the example shown in FIGS. 7 and 8, with added adjustability and controllability for the feedforward filter 902 and the feedback filter 904.

In one scenario, a wind detector 908, e.g, as part of or whose function is performed by the filter coefficient controller 906, analyzes signals from the external microphone 602, the internal microphone and the accelerometer 706, and detects wind noise, and changes in wind noise. For example, the wind detector 908 could perform a fast Fourier transform or other spectral analysis of the signals and look for a spectral signature of wind noise. Or, the wind detector 908 could determine that the internal microphone 610 signal resembles a passively high-pass filtered version of the external microphone signal (e.g., contains substantial low-frequency sound), but also determine that the sound differs from the low-frequency vibration picked up by the accelerometer which is more likely speech, breath, heartbeat or footfalls. Based on that, the filter coefficient controller 906 could deduce that the low-frequency sound being picked up by the external microphone is likely wind. Other forms of signature matching, difference analysis, frequency and amplitude analysis, etc., may be developed and used in the filter coefficient controller 906, in keeping with the teachings herein.

When the wind detector 908 detects presence of wind noise or increased wind noise, the filter coefficient controller 906 reduces the gain of the lower frequencies in the feedforward filter 902 relative to the higher frequencies. Conversely, when the wind detector 908 detects absence of wind noise, or decreased wind noise, the filter coefficient controller 906 increases the gain of the lower frequencies in the feedforward filter 902 relative to the higher frequencies. This could be done with, for example, a stepwise gain function, or linear or nonlinear adjustment of gain relative to amplitude of wind noise. The filtering could be implemented with a variable, adjustable high pass filter, a shelf filter, multiple selectable filters, or various other filters. This could be accompanied by amplification in the feedforward path, to compensate for passive attenuation of higher frequencies by the headphone obstruction of the aural canal 104.

Meanwhile, the filter coefficient controller 906 also adjusts the feedback filter 904 based on detecting wind noise, absence of wind noise, increase in wind noise or decrease wind noise, etc., to compensate for the change in gain of the lower frequencies relative to the higher frequencies in the feedforward filter 902. The feedback filter 904 is also adjusted to compensate for the occlusion effect (that is also caused by the headphone obstruction the aural canal.) More specifically, the feedback path produces a correction signal to reduce booming of the wearer's voice that is produced in the aural canal through the bone conduction 404, and otherwise perform occlusion effect mitigation.

Outputs of the feedforward path and the feedback path are combined, for example in the summer 606, to produce a signal for the driver 608. With the filters 902, 904 tuned by the filter coefficient controller 906, the driver 608 produces sound in the aural canal 104 that has transparency (external sound is reproduced) with reduced wind noise, e.g., relative to the wind noise that is picked up by the external microphone 602, and also has occlusion effect mitigation. In some versions, the audio processing combines the signal from the internal microphone and the signal from the accelerometer, for a single input to the feedback filter 904, in the feedback path, as shown by the dashed lines in FIG. 9.

The driver 608 and internal microphone 610 may be positioned to face the entrance of the aural canal, or insert into the aural canal 104, and the accelerometer is positioned to receive vibration through bone conduction, e.g., by being physically coupled to the wearer's ear or cheek. The external microphone may be positioned to directly receive sound external to the headphone and the aural canal 104. In one version, the headphone is a single unit, for use with a single ear of a listener. In another version, headphones for a listener have one headphone for one ear and another headphone for the other ear, and each headphone may have its separate copy of the audio processing and other components described above. This may be desirable when the headphones are a pair of wireless earbuds where each can be used by itself without the other. In other instances, such as in a pair of bridged headphones, some of the hardware described above may be shared by both headphones, e.g., the accelerometer is positioned in only the left headphone.

In yet another version, a headset has one headphone for one ear, another headphone for the other ear, and a further microphone that is outside of the headphone housings and positioned in front of the mouth, e.g. on a boom, on another rigid structure that is coupled to the headset, or on a cable that tether the headset to for example a portable device such as a smartphone or a tablet computer. The further microphone in that case could be used to acoustically pick up the wearer's voice and ambient sounds, either by itself or as part of a pickup beamformer.

The filters and other digital audio processing described above can be implemented with one or more processors (generically referred to here as "a processor"), for example a digital signal processor that is executing the appropriate software (instructions) that is stored in memory. The processor and memory may be entirely within a headphone housing, or the operations may be "distributed" as two or more processor-memory combinations, e.g., one processor-memory is housed within the headphone housing and another is housed within for example a smartphone or a tablet computer that may be carried by the wearer and that is in wireless or wired communication with the processor-memory that in the headphone Some versions of the audio processing systems described above with reference to FIGS. 7-9 could perform directional suppression in the external sound pickup of the feedforward path, using multiple external microphones. For example, audio processing could apply beamforming for multiple microphone signals, and directionally suppress sound pickup in one or more beam directions. Transparency, occlusion effect mitigation and wind noise reduction are then applied through the audio processing as described above.

While certain aspects have been described and shown in the accompanying drawings, it is to be understood that such are merely illustrative of and not restrictive on the broad invention, and that the invention is not limited to the specific constructions and arrangements shown and described, since various other modifications may occur to those of ordinary skill in the art. For example, while FIG. 9 depicts a device in which there are separate filters and single examples of the external microphone, internal microphone and accelerometer, it is also possible to have combined filters, and/or more than one external microphone, internal microphone or accelerometer whose outputs may be combined, e.g., acoustic pickup beamforming of multiple external microphone signals. The description is thus to be regarded as illustrative instead of limiting.

What is claimed is:

1. An audio processing system for headphone transparency, comprising:

a headphone having a driver, an internal microphone, an accelerometer, and an external microphone; and an audio processor to:

detect increased wind noise by analyzing one or more of signals from the internal microphone, the external microphone and the accelerometer, wherein the increased wind noise is detected by analyzing a difference in low frequency components of acoustic signals picked up by the internal microphone configured to detect sound waves in an aural canal of a user of the headphone and low frequency components of vibration signals picked up by the accelerometer configured to detect vibrations of bone conduction of the user;

reduce gain of lower frequencies relative to higher frequencies in a first filter that is operating on the signal from the external microphone in a feedforward path, responsive to detecting the increased wind noise;

adjust a second filter, in a feedback path, that is operating on the signal from the accelerometer, wherein the second filter is adjusted based on detecting the increased wind noise; and combine outputs of the feedforward path and the feedback path to produce a signal for the driver to produce sound in the aural canal of a user of the headphone.

2. The audio processing system of claim 1, wherein the audio processor is to adjust the second filter in the feedback path based on detecting the increased wind nose, to compensate for the reduced gain of the lower frequencies relative to the higher frequencies in the first filter and thereby mitigate an occlusion effect that is caused by positioning of the headphone relative to the aural canal.

3. The audio processing system of claim 1, wherein to mitigate an occlusion effect that is caused by positioning of the headphone relative to the aural canal, the audio processor is to configure the second filter in the feedback path to produce an audio signal of the feedback path that reduces booming of the user's voice in the aural canal through the bone conduction.

4. The audio processing system of claim 1, wherein the audio processor is to combine the signal from the internal microphone and the signal from the accelerometer, at an input of the second filter, in the feedback path, and wherein the feedforward path contains amplification to compensate for passive attenuation of the headphone.

5. The audio processing system of claim 1 wherein the headphone comprises a headphone housing in which the audio processor is integrated.

6. The audio processing system of claim 1, wherein the first filter comprises an adjustable high-pass filter.

7. The audio processing system of claim 1, wherein to compensate for a higher noise floor of the accelerometer, the audio processor comprises a noise suppressor having an input to receive the signal from the accelerometer and an output that is in the feedback path.

8. The audio processing system of claim 1, further comprising:

one or more further external microphones; and wherein the audio processor is to perform directional sound pickup suppression using signals from two or more of the external microphones and the one or more further external microphones to produce an audio signal of the feedforward path.

9. The audio processing system of claim 1, further comprising a further headphone having further audio processing, the headphone and the further headphone integrated as a pair of headphones or a headset.

10. The audio processing system of claim 1, wherein the audio processor is configured to increase gain of the lower frequencies relative to the higher frequencies in the first filter in the feedforward path, responsive to detecting decreased or no wind noise.

11. A method of audio processing for headphone transparency, comprising:

analyzing one or more of signals from an internal microphone, an external microphone and an accelerometer of a headphone, to detect wind noise, wherein the wind noise is detected by analyzing a difference in low frequency components of acoustic signals picked up by the internal microphone that detects sound waves in an aural canal of a user of the headphone and low frequency components of vibration signals picked up by the accelerometer that detects vibrations of bone conduction of the user;

reducing gain of lower frequencies relative to higher frequencies in a first filter that is operating upon the signal from the external microphone in a feedforward path, responsive to detecting increased wind noise;

adjusting a second filter, in a feedback path, that is operating upon the signal from the accelerometer wherein the second filter is adjusted based on detecting the increased wind noise; and combining output of the feedforward path and output of the feedback path to produce a signal for a driver to produce sound, in the aural canal of a user of the headphone, that reduces wind noise as compared to when the second filter is operating upon the signal from the internal microphone rather than upon the signal from the accelerometer.

12. The method of claim 11, wherein adjusting the second filter in the feedback path is to i) compensate for the reduced gain of the lower frequencies relative to the higher frequencies in the first filter in the feedforward path and mitigate an occlusion effect caused by the headphone relative to the aural canal.

13. The method of claim 11, wherein the second filter in the feedback path is configured to produce an audio signal in the feedback path that reduces booming of the user's voice in the aural canal through bone conduction.

14. The method of claim 11, further comprising:

combining the signal from the internal microphone and the signal from the accelerometer, at an input of the second filter in the feedback path.

15. The method of claim 11, performed by an audio processor that is integrated in a headphone housing of the headphone.

16. The method of claim 11, wherein the reducing the gain of the lower frequencies relative to the higher frequencies in the first filter comprises adjusting a high-pass filter.

17. The method of claim 11, further comprising increasing the gain of the lower frequencies relative to the higher frequencies in the first filter in the feedforward path, responsive to detecting a decrease or absence of the wind noise.

18. A method of audio processing:

reducing gain of lower frequencies relative to higher frequencies in a first filter that is operating upon an audio signal from an external microphone in a feedforward path, responsive to detecting increased wind noise, wherein the increased wind noise is detected by analyzing a difference in low frequency components of acoustic signals picked up by an internal microphone that detects sound waves in an aural canal of a user and low frequency components of vibration signals picked up by an accelerometer that detects vibrations of bone conduction of the user;

adjusting a second filter, in a feedback path, that is operating upon an audio signal from an accelerometer wherein the second filter is adjusted based on detecting the increased wind noise; and combining audio signal output of the feedforward path and audio signal output of the feedback path to produce an audio signal for input to a driver to produce sound, in the aural canal of a user of a headphone, which has transparency with reduced wind noise relative to sound external to the headphone.

19. The method of claim 18 wherein adjusting the second filter in the feedback path is to i) compensate for the reduced gain of the lower frequencies relative to the higher frequencies in the first filter in the feedforward path and mitigate an occlusion effect caused by the headphone relative to the aural canal.

20. The method of claim 18, further comprising increasing the gain of the lower frequencies relative to the higher frequencies in the first filter in the feedforward path, responsive to detecting a decrease or absence of the wind noise.

* * * * *